US007347010B2

(12) United States Patent
Yu

(10) Patent No.: US 7,347,010 B2
(45) Date of Patent: Mar. 25, 2008

(54) SHOE HAVING A VARIETY OF LACING STYLES

(76) Inventor: Zu Sheng Yu, 31 Bayview Dr., Huntington, NY (US) 11743

( * ) Notice: Subject to any disclaimer, the term of this patent is extended or adjusted under 35 U.S.C. 154(b) by 448 days.

(21) Appl. No.: 11/057,730

(22) Filed: Jan. 29, 2005

(65) Prior Publication Data

US 2005/0132616 A1 Jun. 23, 2005

Related U.S. Application Data

(63) Continuation-in-part of application No. 10/976,538, filed on Oct. 30, 2004, and a continuation-in-part of application No. 10/402,713, filed on Mar. 28, 2003, now Pat. No. 7,272,897.

(51) Int. Cl.
*A43B 3/12* (2006.01)

(52) U.S. Cl. ..... 36/11.5; 36/100; 36/101

(58) Field of Classification Search ..... 36/11.5, 36/100, 101, 15

See application file for complete search history.

(56) References Cited

U.S. PATENT DOCUMENTS

| | | | | | |
|---|---|---|---|---|---|
| 2,112,884 | A * | 4/1938 | Gillette et al. | ..... | 36/11.5 |
| 2,367,092 | A * | 1/1945 | Blotner | ..... | 36/11.5 |
| 2,526,940 | A * | 10/1950 | Fello | ..... | 36/11.5 |
| 2,680,309 | A * | 6/1954 | Peterson | ..... | 36/11.5 |
| 2,862,311 | A * | 12/1958 | Ellis | ..... | 36/11.5 |
| 3,455,037 | A * | 7/1969 | Vlas et al. | ..... | 36/11.5 |
| 3,902,259 | A * | 9/1975 | Cracco | ..... | 36/11.5 |
| 4,020,569 | A * | 5/1977 | Fukuoka | ..... | 36/29 |
| 4,333,247 | A * | 6/1982 | Marinelli | ..... | 36/11.5 |
| 4,936,028 | A * | 6/1990 | Posacki | ..... | 36/15 |
| 5,339,543 | A * | 8/1994 | Lin | ..... | 36/101 |
| 5,430,621 | A | 7/1995 | Raskas | | |
| 5,953,836 | A * | 9/1999 | Watt et al. | ..... | 36/42 |
| 6,418,643 | B1 * | 7/2002 | Yang | ..... | 36/101 |
| 6,442,870 | B1 * | 9/2002 | Tsai | ..... | 36/11.5 |
| 6,769,204 | B1 * | 8/2004 | Phillips | ..... | 36/136 |
| 2005/0016018 | A1 * | 1/2005 | Cagner | ..... | 36/11.5 |

FOREIGN PATENT DOCUMENTS

| | | |
|---|---|---|
| DE | 9207267 U1 | 7/1992 |
| EP | 0342170 | 11/1989 |
| GB | 479921 | 2/1938 |
| GB | 2147792 | 5/1985 |

* cited by examiner

*Primary Examiner*—Marie Patterson
(74) *Attorney, Agent, or Firm*—F. Chau & Associates, LLC

(57) ABSTRACT

An article of footwear comprises a first sole including a lip having a plurality of bores from top to bottom of the first sole, the plurality of bores of the lip are spaced apart and disposed around its perimeter, wherein the plurality of bores receive a lace that extends through the plurality of bores for receiving a wearer's foot, and a second sole, wherein the first sole and the second sole are dimensioned and shaped so that the second sole is removably engaged with the first sole.

19 Claims, 5 Drawing Sheets

SHOE HAVING A VARIETY OF LACING STYLES

CROSS REFERENCE TO RELATED APPLICATION

This application is a continuation-in-part of commonly assigned application Ser. No. 10/976,538, filed Oct. 30, 2004, pending, and is a CIP of Ser. No. 10/402,713, filed on Mar. 28, 2003 now U.S. Pat. No. 7,272,897, and Ser. No. 10/976,538, filed on Oct. 30, 2004, the disclosure of which in their entirety are incorporated by reference herein.

TECHNICAL FIELD

The present invention relates generally to an article of footwear, and more specifically, to shoes having an interchangeable insole.

DISCUSSION OF RELATED ART

Footwear includes a shoe top and a sole. Typically, the sole is made of a soft and padded insole for soothing and a flexible outsole for fraction and durability. Recently, replaceable insoles are used to improve shock absorption. For example, gel insoles such as Air-Pillo Gel Insoles of Dr.Scholl's™ are used to adsorb shock and provide cushioning comfort. Conventional insoles are used inside of a shoe having an outsole and a shoe top because the insole can be supported by the outsole and the shoe top.

For certain kinds of shoes such as sandals or flips, single sole is typically used because sandals or flips comprise a lace that is difficult to support insoles securely. A shoe wearer for the certain kinds of shoes may desire to replace old insoles and outsoles with new insoles and outsoles having different thicknesses, materials, and/or aesthetic styles. Being not detachable, the certain kinds of shoes are used without replacing insoles and outsoles.

SUMMARY OF THE INVENTION

In one exemplary embodiment of the present invention, an article of footwear comprises a first sole including a lip having a plurality of bores from top to bottom of the first sole, the plurality of bores of the lip are spaced apart and disposed around its perimeter, wherein the plurality of bores receive a lace that extends through the plurality of bores for receiving a wearer's foot, and a second sole, wherein the first sole and the second sole are dimensioned and shaped so that the second sole is removably engaged with the first sole.

In another exemplary embodiment of the present invention, an article of footwear comprises an outsole including a lip having a plurality of bores from top to bottom of the outsole, the plurality of bores of the lip are spaced apart and disposed around its perimeter, a removable insole, wherein the outsole and the removable insole are secured together by a locking mechanism, and a lace for extending through the plurality of bores to wrap around any portions of a wearer's toes, foot, ankle, calf and leg in a plurality of decorative styles.

In still another exemplary embodiment of the present invention, an article of footwear comprises a first sole including a lip having a plurality of bores from top to bottom of the first sole, the plurality of bores of the lip are spaced apart and disposed around its perimeter, a second sole, wherein the first sole and the second sole are dimensioned and shaped so that the second sole is removably attached to the first sole, and a lace for extending through the plurality of bores of the lip for receiving a wearer's foot.

DETAILED DESCRIPTION OF PREFERRED EMBODIMENTS

Figure 1:
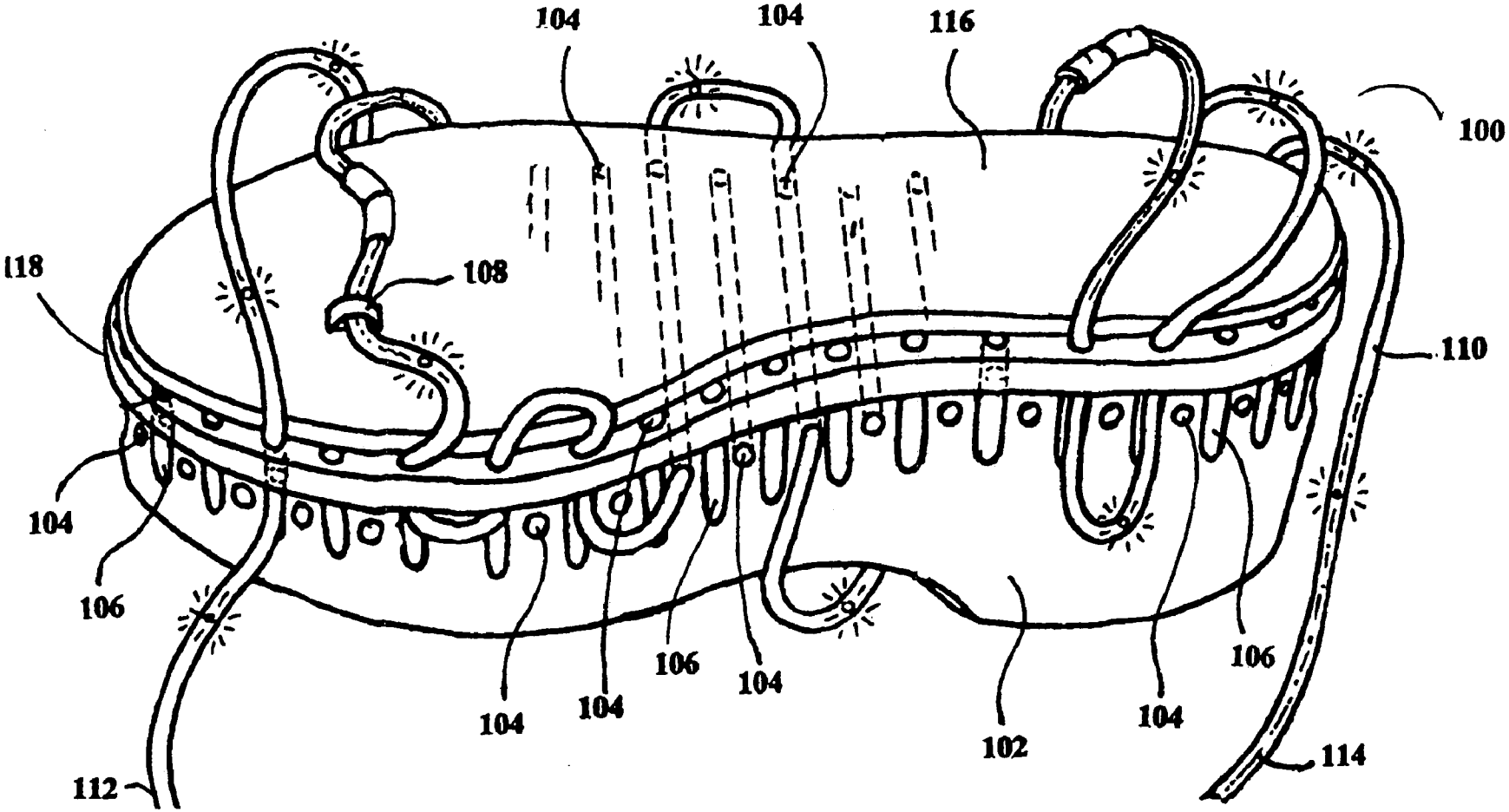
FIG. 1 is an exemplary illustration of a sandal according to an embodiment of the present invention.

With reference now to the Figures, the illustration of FIG. 1 depicts an example of a sandal 100 according to an embodiment of the present invention. In general, sandal 100 comprises a sole 102 having a plurality of redirection holes 104, grooves 106, and rings 108 for stringing a lace 110. The lace 110 is preferably a transparent plastic tube having a first end 112 and a second end 114, but can comprise any flexible material. The sole 102 can further include a top layer 116 and a bottom layer 118. The plurality of redirection holes 104 can further be provided between the top layer 116 and the bottom layer 118. The top layer 116 and the bottom layer 118 can be connected together. In still another embodiment according to the present invention, the plurality of redirection holes 104, grooves 106, and rings 108 can string more than one lace (not shown).

Figure 2:
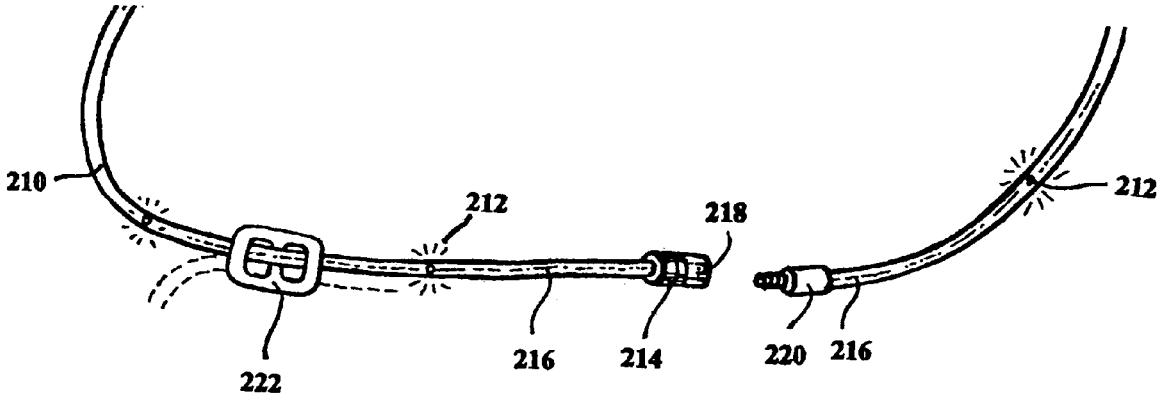
FIG. 2 is an exemplary illustration of a lace according to an embodiment of the present invention.

Referring to FIG. 2, in a preferred embodiment a lace 210 includes lights 212 within its interior surface that can flash or remain constantly illuminated, for decorative purposes. The lace 210 also includes a power supply 214, for example, a battery, that provides electric current to the lights using an electrically conductive material 216 within the interior surface of the lace that is connected to the lights 212 and power supply 214 to form an electric circuit. The power supply 214 can be positioned behind an electrically conductive female connector 218 affixed to the first end of the lace 210 that can be coupled to an electrically conductive male connector 220 affixed to the second end of the lace 210, thereby completing the electric circuit. The lace 210 can further have a plurality of connectors and power supplies (not shown). In another embodiment according to the present invention, the lace includes an adjusting mechanism 222 that adjusts the length of the lace for a comfortable fit of the sandal on the wearer's foot.

Figure 3A:
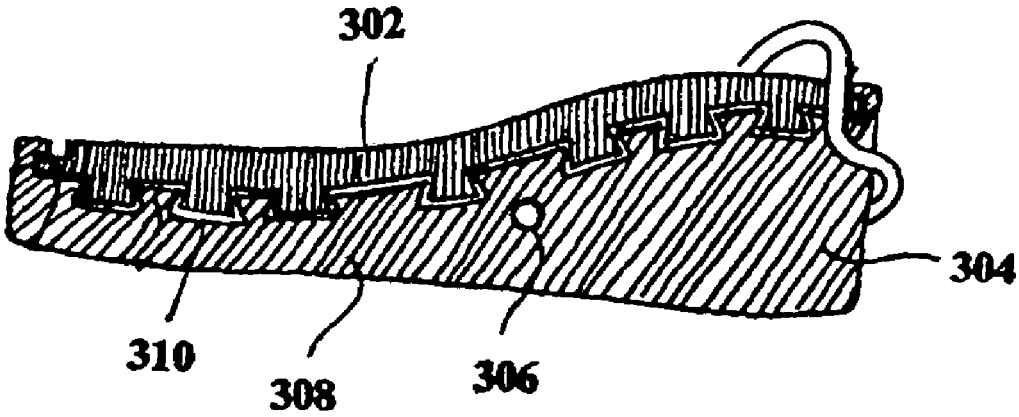
FIG. 3A is an exemplary illustration of a side view of layers of a sole of a sandal according to an embodiment of the present invention.
Figure 3B:
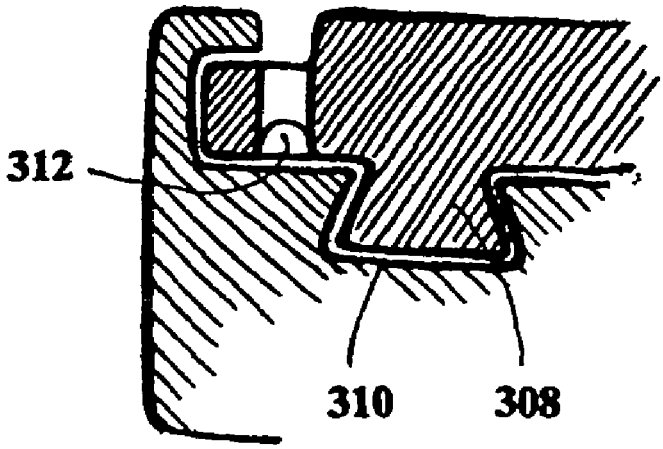
FIG. 3B is an exemplary illustration of a channel incorporated into a sole locking mechanism according to an embodiment of the present invention.

Referring to FIG. 3A, in a preferred embodiment according to the present invention, the sole comprises a plurality of layers. A first layer 302 that is in contact with a wearer's foot and a second layer 304 that is in contact with a surface. The first layer 302 having at least one of a plurality of redirection rings for stringing at least one of a plurality of laces and the second layer 304 having at plurality of redirection holes and grooves for stringing at least one of a plurality of laces, as illustrated in FIG. 1. Again referencing FIG. 3A, the first layer 302 and the second layer 304 are affixed to each other using a locking mechanism. The locking mechanism is preferably comprised of a plurality of tongues 308 arranged on the first layer 302 and a plurality of grooves 310 arranged on the second layer, wherein the plurality of tongues 308 and the plurality of grooves 310 are arranged oppositely to each other such that the plurality of tongues 308 interlock with the plurality of grooves 310 when pressed together. As shown in FIG. 3B, the locking mechanism can further include a channel 312 for stringing a lace thereby hiding the lace from view and obtaining a seamless connection between the first layer 302 and second layer 304. Additionally, any number of layers of soles can be affixed together to obtain a more comfortable fit of the sandal on a wearer's foot.

Figure 4:
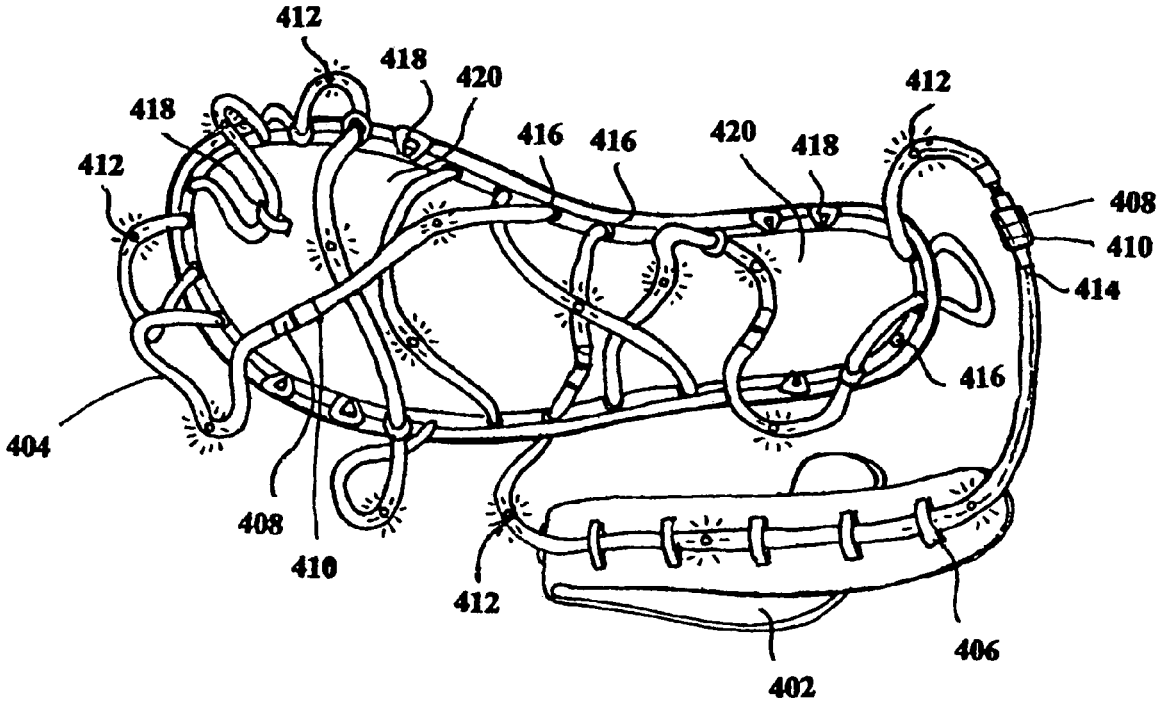
FIG. 4 is an exemplary illustration of a top view of a sandal according to an embodiment of the present invention.

Referring to FIG. 4, a top view of a sandal is illustrated according to an embodiment of the present invention. The lace 404 can include a moveable anti-friction pad 402 positioned over the lace 404 to prevent irritation of a wearer's skin arising from friction of the lace 404 against the skin. The anti-friction pad 402 further includes a plurality of securing devices 406 used to movably affix the anti-friction pad 402 to the lace 404.

Further illustrated are a plurality of electrically conductive connectors 408 (both male and female shown in a connected position) and a plurality of power supplies 410. The electrically conductive connectors 408, the power supplies 410, and a plurality of illumination devices 412 provided within the interior surface of the lace 404, are connected using a electrically conductive material 414 also provided within the interior surface of the lace 404. The lace 404 is strung through a plurality of redirection holes 416, grooves (not shown), and rings 418 that are provided on the perimeter, on a top surface, and within an interior surface (not shown) of a sole 420, thereby forming a receptacle to secure the sole 420 to a wearer's foot. The receptacle formed serves as a top portion of a shoe.

When securing the sandal to a foot, any combination of redirection holes 416, grooves, and rings 418 can be used for stringing the lace 404. Additionally, in conjunction with using any combination of redirection holes 416, grooves, and rings 418, to secure the sandal to the foot, the lace can be wrapped around any portion of the wearer's toes, foot, ankle, calf, and leg in a plurality of decorative styles. Obtaining a plurality of decorative styles from a single pair of sandals advantageously increases the marketability of the sandal.

Figure 5:
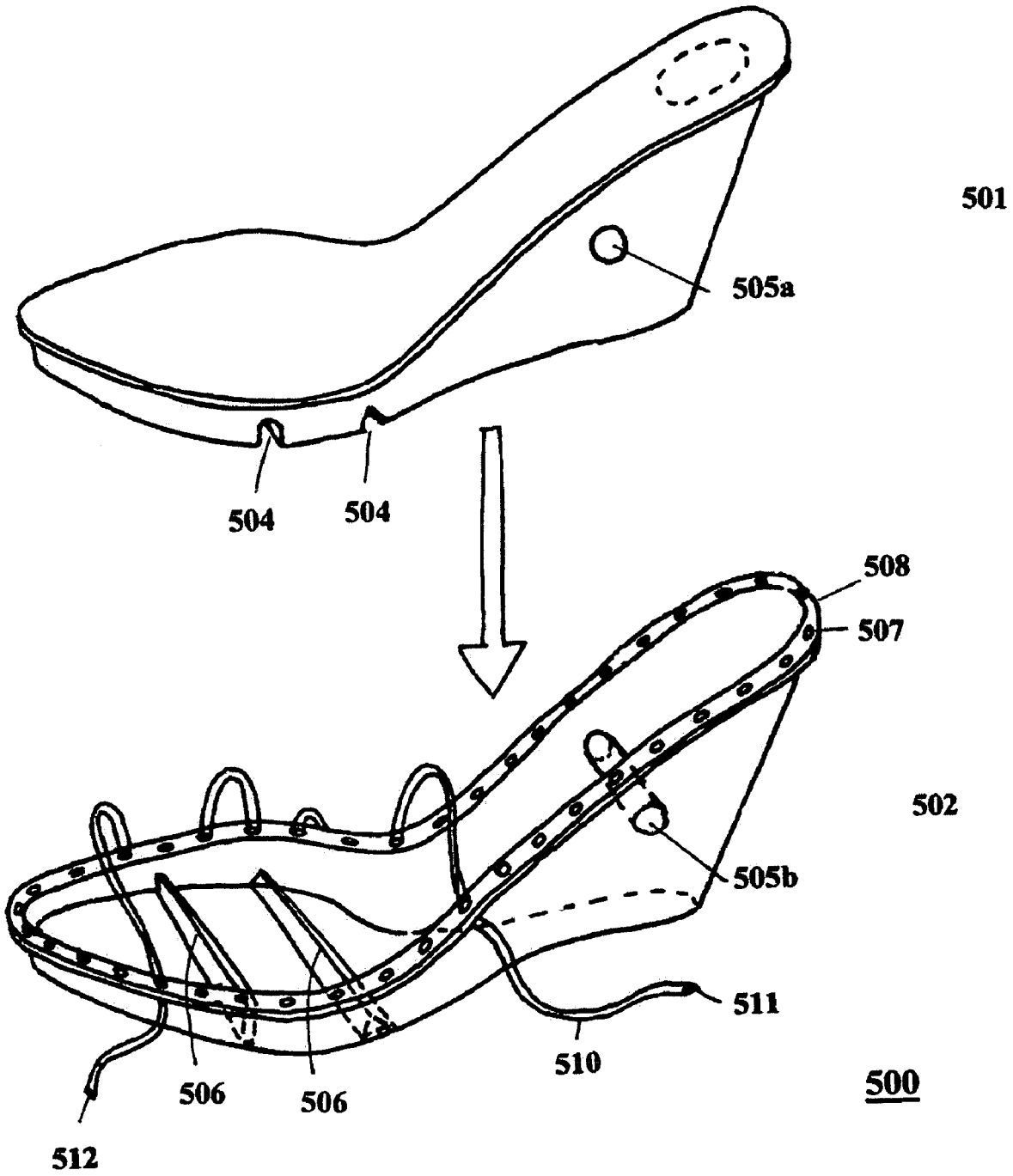
FIG. 5 is an illustration of a shoe according to an exemplary embodiment of the present invention.

The illustration of FIG. 5 shows a shoe 500 according to an exemplary embodiment of the present invention. The shoe 500 comprises an insole 501 and an outsole 502. The insole 501 is removably attached to the outsole 502. The insole 501 includes a securing channel 505*a* and a plurality of securing grooves 504 formed from one side to another side of the insole 501. The outsole 502 includes a plurality of securing holes 505*b* and a plurality of securing tongues 506. The outsole 502 may further include a lip 508 with a plurality of bores 507 from top to bottom of the outsole 502. The plurality of bores 507 of the lip 508 are spaced apart and disposed around its perimeter. The lip 508 is provided along a perimeter of top portion of the outsole 502. In general, the insole 501 is in contact with a wearer's foot and the outsole 502 is in contact with a walking surface.

In one exemplary embodiment of the present invention, the insole 501 is fitted into the outsole 502, and the securing channel 505*a* of the insole 501 matches the securing holes 505*b* of the outsole 502 so that a securing device such as a rod (not shown) may be inserted through the channel to secure the insole 501 and the outsole 502. According to this embodiment, the insole 501 is shaped like the shape of the outsole 502, and is dimensioned so that the insole 501 fits within the outsole 502 snugly and in conformance to the contours and bends of the outsole 502.

In another exemplary embodiment of the present invention, the plurality of securing tongues 506 in the outsole 502 can be inserted into the plurality of securing grooves 504 in the insole 501 for securing the insole 501 and the outsole 502. Alternatively, the outsole 502 may include the plurality of securing grooves 504, and the insole may include the plurality of securing tongues 506. The tongue and groove system facilitates ease of adding the insole 501 to the outsole 502. One skilled in the art can readily appreciate a lip having a plurality of bores can be formed on the insole 501 instead of on the outsole 502, or alternatively a lip having a plurality of bores can be formed in between or in both the insole 501 and the outsole 502.

In another exemplary embodiment of the present invention, a shoe wearer may change a style of a shoe by using a different thickness, a different color, and/or a different material of either the insole 501 or the outsole 502. For example, a soft cushioning material can be used for the insole 501. A rubber bottom can be used for the outsole 502 for wearing in slippery conditions. In one exemplary embodiment of the present invention, the outsole 502 can be made from a transparent material so that insoles can be seen from any sides of the shoe 500.

A lace 510 can be used for extending through the plurality of bores 507 to wrap around any portion of the wearer's toes, foot, ankle, calf, and legs in a plurality of decorative styles. In such case, the shoe 500 can be worn without a shoe top. The lace 510 is preferably a transparent plastic tube having a first end 511 and a second end 512, but can comprise any flexible material. Details of the lace 510 are same with the details of the lace 210 described in FIG. 2. The lace 510 secures the insole 501 and the outsole 502 to wearer's foot. When securing the insole 501 and the outsole 502 to wearer's foot, any combination of holes can be used for stringing the lace 510. In addition, to obtain a plurality of decorative styles, jewelry, colored plastics, or pieces of leather can be removably affixed to the lace 510.

Although illustrative embodiments of the present invention have been described herein with reference to the accompanying drawings, it is to be understood that the invention is not limited to those precise embodiments, and that various other changes and modifications may be affected therein by one skilled in the art without departing from the scope or spirit of the present invention.

What is claimed is:

1. An article of footwear comprising:

an insole having a surface for receiving a wearer's foot; and an outsole having a body portion and a lip attached to the body portion, the body portion dimensioned and shaped to substantially coincide with the surface of the insole, wherein the lip extends outside the insole and the body portion of the outsole, and has a plurality of bores positioned to be accessible to facilitate reconfiguration of the footwear by stringing a lace through the plurality of bores.

2. The article of footwear of claim 1, wherein the lip is provided along a perimeter of top portion of the outsole.

3. The article of footwear of claim 1, wherein the insole is removably engaged with the outsole.

4. The article of footwear of claim 1, wherein the outsole further includes a plurality of tongues and the insole further includes a plurality of grooves, wherein the plurality of tongues are inserted into the plurality of grooves for securing the outsole and the insole.

5. The article of footwear of claim 1, wherein the outsole includes securing holes and the insole includes a securing channel, the insole being fitted into the outsole and the securing channel matches the securing holes so that a securing device is inserted through the securing channel and the securing holes to secure the insole and the outsole.

6. The article of footwear of claim 5, wherein the securing device includes a rod.

7. The article of footwear of claim 1, wherein the lace is made from a flexible material.

8. The article of footwear of claim 7, wherein decorative articles are affixed onto the lace.

9. The article of footwear of claim 8, wherein the decorative articles include one of jewelry, colored plastics, and pieces of leather.

10. The article of footwear of claim 1, wherein the outsole and the insole comprise different materials.

11. The article of footwear of claim 1, wherein the outsole is made from a transparent material.

12. An article of footwear comprising:

an insole having a surface for receiving a wearer's foot; and an outsole having a body portion and a lip attached to the body portion, wherein the insole is shaped and dimensioned to conform and fit within the body portion of the outsole, wherein the lip extends outside the insole and the body portion of the outsole, and has a plurality of bores positioned to be accessible to facilitate reconfiguration of the footwear by stringing a lace through the plurality of bores to wrap around any portions of a wearer's toes, foot, ankle, calf and leg in a plurality of decorative styles.

13. The article of footwear of claim 12, wherein the lip is provided along a perimeter of top portion of the outsole.

14. The article of footwear of claim 12, wherein the insole and the outsole are attached to each other using a tongue-and-groove system.

15. The article of footwear of claim 12, wherein the lace is made from a flexible material.

16. The article of footwear of claim 15, wherein decorative articles are affixed onto the lace.

17. The article of footwear of claim 16, wherein the insole and the outsole are removably engaged with each other.

18. The article of footwear of claim 12, wherein the insole and the outsole comprise different materials.

19. The article of footwear of claim 12, wherein the outsole is made from a transparent material.

* * * * *